United States Patent [19]

Cronin et al.

[11] 3,986,364

[45] Oct. 19, 1976

[54] MARINE TURBINE CONTROL

[75] Inventors: Michael J. Cronin, Salem; Bruce D. Taber, Boxford; Harvey H. Chamberlain, Marblehead, all of Mass.

[73] Assignee: General Electric Company, Schenectady, N.Y.

[22] Filed: Mar. 17, 1975

[21] Appl. No.: 559,178

[52] U.S. Cl. ..... 60/706; 60/660

[51] Int. Cl.[2] ..... F01K 13/02

[58] Field of Search ..... 60/660, 706; 415/30, 415/36, 17

[56] References Cited

UNITED STATES PATENTS

| | | | |
|---|---|---|---|
| 3,361,108 | 1/1968 | Hobbs | 60/706 |
| 3,392,696 | 7/1968 | Buckley, Jr. | 60/706 |
| 3,405,676 | 10/1968 | Hobbs et al. | 60/706 |
| 3,422,831 | 1/1969 | Straney et al. | 60/706 |
| 3,859,006 | 1/1975 | Randell | 415/17 |

OTHER PUBLICATIONS

*Los Angeles Section of the Society of Naval Architects and Marine Engineers*, Mar. 9, 1972: "The Control of Propulsion Power Aboard Steam Ships" by Prohl & Spears.

*Tradewinds*, Nov. 1972: "Turbine Topics: Fundamentals of the New Electrohydraulic Throttle Control System" by M. A. Prohl.

*American Society of Naval Engineers, Delaware Valley Section*, Jan. 18, 1973: "The Control of Propulsion Power Aboard Steam Propelled Naval Ships" by Prohl & Spears.

*Marine Engineering/Log* Sept., 1973: "G.E.'s New Turbine Control Package" by M. A. Prohl.

*Primary Examiner*—Allen M. Ostrager

*Attorney, Agent, or Firm*—James W. Mitchell; John F. Ahern

[57] ABSTRACT

A control system for a marine turbine power plant is disclosed wherein the input signal to an electrohydraulic valve positioning circuit for ahead and astern turbines may be directly related to a desired valve position signal input set at a throttle lever. Hence, primary control is by a desired valve position signal. A speed feedback circuit is included and selectively applied to the desired valve position signal as a valve position trimming signal. Another input into the primary control or desired valve position is a malfunction proportional control signal which tracks boiler operation, shaft vibration and overspeed. The valve position signal is applied to the valve positioning circuit through a rate limiter which may be set at a fast, normal, or slow rate depending upon an input from a system interface board.

9 Claims, 7 Drawing Figures

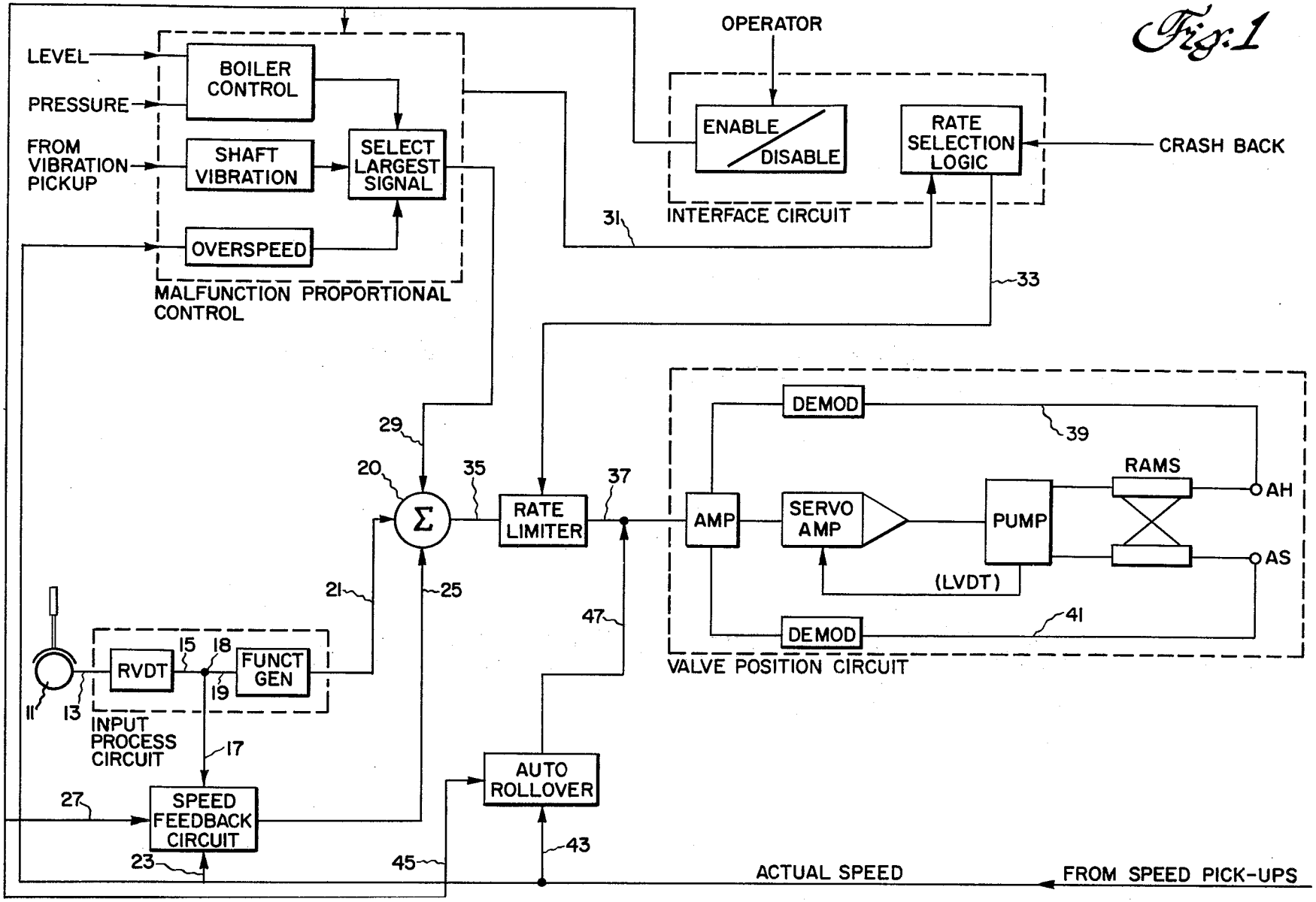
Fig. 1
CRASH BACK
RATE SELECTION LOGIC
OPERATOR
ENABLE
DISABLE
INTERFACE CIRCUIT
33
31
AH
AS
RAMS
39
41
PUMP
(LVDT)
DEMOD
SERVO AMP
DEMOD
AMP
VALVE POSITION CIRCUIT
FROM SPEED PICK-UPS
ACTUAL SPEED
37
47
RATE LIMITER
AUTO ROLLOVER
43
35
25
29
20
45
21
SELECT LARGEST SIGNAL
BOILER CONTROL
SHAFT VIBRATION
OVERSPEED
MALFUNCTION PROPORTIONAL CONTROL
FUNCT GEN
18
19
17
15
RVDT
INPUT PROCESS CIRCUIT
SPEED FEEDBACK CIRCUIT
23
13
27
11
LEVEL
PRESSURE
FROM VIBRATION PICKUP DIRECTION CONTROL LOGIC
BRIDGE LIMITER
DISABLE LOGIC
THRESHOLD CIRCUIT
HP1
HP2
AS(+)
AH(−)
+5
+15
−15
Σ

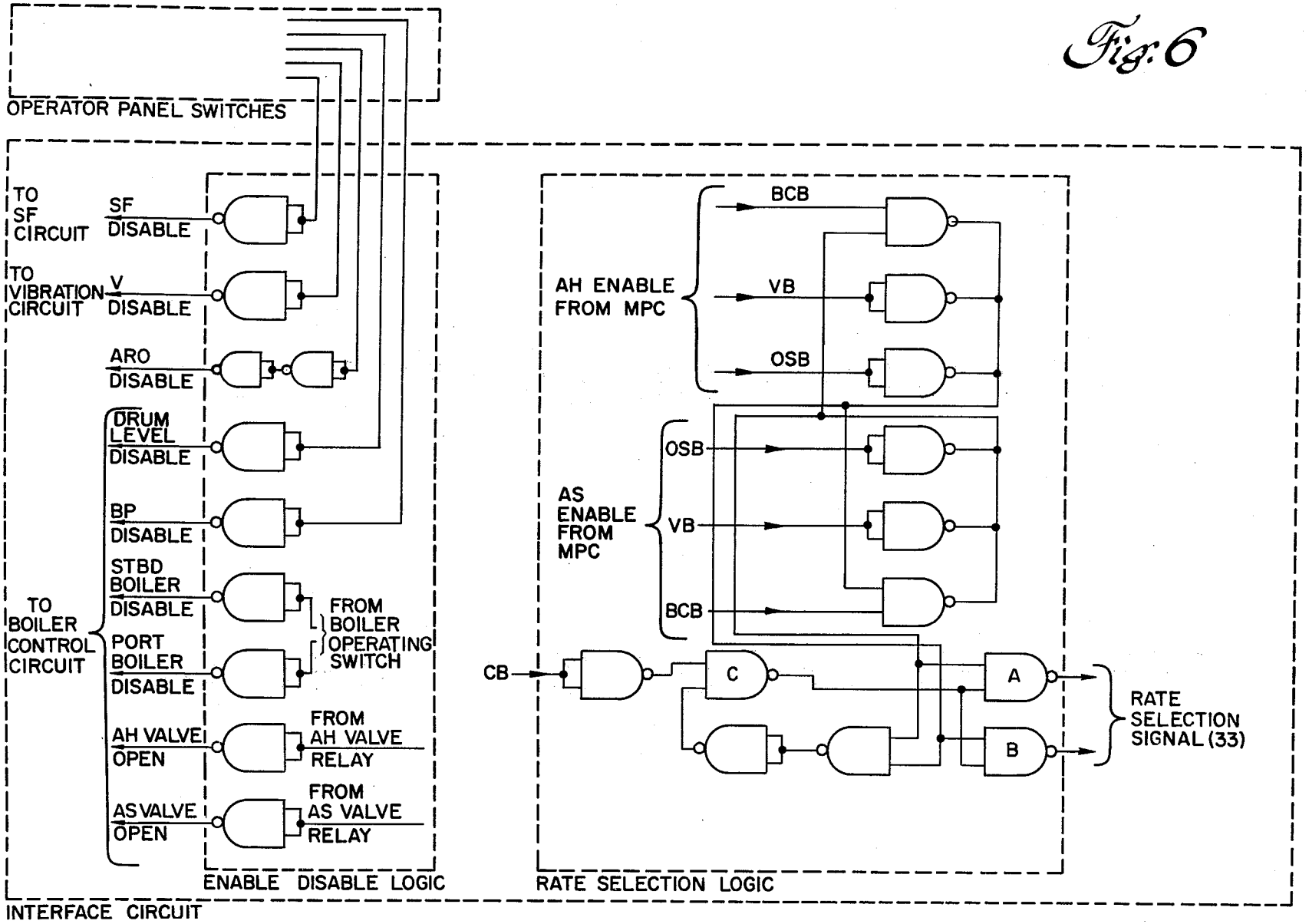
Fig. 6
RATE SELECTION SIGNAL (33)
A
B
C
BCB
VB
OSB
AH ENABLE FROM MPC
OSB
VB
BCB
AS ENABLE FROM MPC
CB
RATE SELECTION LOGIC
OPERATOR PANEL SWITCHES
TO SF CIRCUIT
SF DISABLE
TO VIBRATION CIRCUIT
V DISABLE
ARO DISABLE
DRUM LEVEL DISABLE
BP DISABLE
STBD BOILER DISABLE
FROM BOILER OPERATING SWITCH
PORT BOILER DISABLE
FROM AH VALVE RELAY
AH VALVE OPEN
FROM AS VALVE RELAY
AS VALVE OPEN
TO BOILER CONTROL CIRCUIT
ENABLE DISABLE LOGIC
INTERFACE CIRCUIT

MARINE TURBINE CONTROL

BACKGROUND OF THE INVENTION

This invention relates, in general, to power plants, and in particular, this invention relates to a control system for a marine turbine power plant.

One prior art example of a marine turbine power plant is found in U.S. Pat. No. 3,405,676 to Hobbs et al issued Oct. 15, 1968. The control system described in that patent is primarily a speed control system in that a desired speed input (throttle control) is continuously compared with an actual speed input (tachometer feedback) to produce a speed error signal when the desired and actual speeds differ. The speed error signal is input into an integrator circuit (speed control amplifier), the output of which is input into valve operating servos for changing valve position to compensate for the speed error. The integrator circuit output is continuous until the speed error is zero. Also shown in the Hobbs patent is a means for limiting the integrator output signal so that it does not exceed a voltage limit which would cause a boiler malfunction.

One object of the present invention is to eliminate the necessity of a speed feedback input under all operating conditions. It has been found that speed feedback at high rpm operating conditions is unnecessary for adequate ship control. Moreover, speed feedback at high rpm's can cause undesirable and unnecessary valve travel excursions in a speed control system because the system requires the actual speed to equal the desired speed even when such a requirement is not otherwise necessary for ship control.

Another object of the present invention is to provide a means for proportionately closing turbine valves to compensate for a boiler malfunction, an overspeed malfunction or a vibration malfunction. This is distinguished from a system which limits the opening of turbine valves in order to avoid causing a turbine trip.

Another object of the present invention is to select a rate for closing and reopening turbine valves in accordance with the aforementioned turbine malfunction proportional control and other system requirements.

In accordance with the aforementioned objects of the invention, the present invention is a marine turbine control system which is primarily a valve position control system having a selectively input speed error modification, a malfunction proportional control modification and a rate limiter modification. A throttle lever input is a valve position demand signal which is modified by a function generator to provide a valve position command linearly proportional to the valve position demand. Hence, valve position may be controlled without speed feedback.

As was previously alluded to, sometimes it is desirable to incorporate speed feedback into the turbine control system. For this reason, a speed feedback control loop is incorporated into the valve position control as a valve position command trimming signal. This is distinguished from the prior art wherein the speed error signal is the valve control signal.

An additional modification to the valve command signal may be a malfunction proportional control signal which overrides the valve position command signal to close the turbine valves upon the occurrence of a malfunction signal. The amount of valve closing is proportional to the malfunction so that the net result will be a valve closing which tracks the malfunction.

The rate at which the valves open and close is set in a rate limiter means having an input from the malfunction proportional control through an interface circuit.

The foregoing is but a brief introduction into the objects, advantages and operation of the present invention. Other objects and advantages will become apparent from the following detailed description of the invention and the novel features will be particularly pointed out hereinafter in the claims.

BRIEF DESCRIPTION OF THE DRAWINGS

FIG. 1 is a functional block diagram of a marine turbine control according to the present invention.

FIG. 6 is a circuit diagram of the interface circuit.

DETAILED DESCRIPTION OF THE INVENTION

Figure 2:
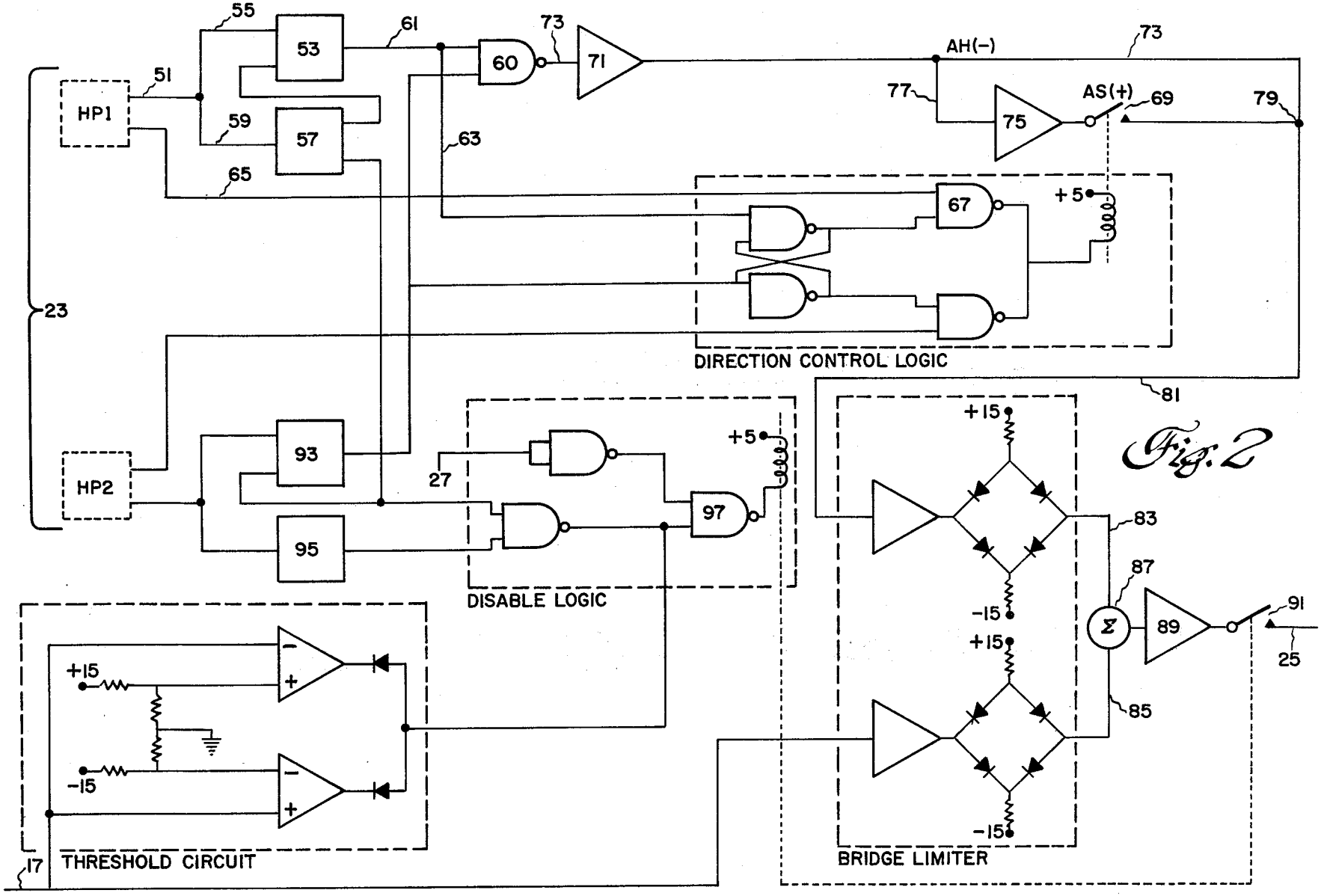
FIG. 2 is a block diagram of a speed feedback circuit with certain blocks thereof showing circuits in detail.

FIG. 1 is a function block diagram of an integrated turbine control system according to the present invention. The overall control system as set forth is particularly suited for marine use although particular portions thereof may be useful in the control of any steam turbine.

A desired turbine shaft speed is set on a throttle lever 11 in either the ahead direction or the astern direction. The throttle lever is mechanically connected to a synchro-transmitter not shown. The synchro-transmitter is a device which provides an AC output voltage which is phase sensitive (0° phase shift or 180° phase shift). The output voltage is proportional to the angular displacement of the throttle lever whereas the phase of the output signal represents either ahead or astern travel of the throttle lever. Although there is only one throttle lever shown, it is well known that two or more throttles may be present aboard ship (e.g., engine room, bridge) to provide an input location although only one throttle lever is in control at any particular time.

The throttle output via the synchro-transmitter is input into an input process circuit through line 13. A rotary variable differential transformer (RVDT) is a phase sensitive device which provides a DC output voltage on line 15 having a magnitude proportional to the throttle lever shaft speed setting and a polarity corresponding to the phase of the RVDT input signal which may be positive or negative to indicate ahead or astern travel direction.

The output signal on line 15 is simultaneously input into a speed feedback circuit through line 17 and also, input into a function generator circuit through node 18. The signal on line 17 is a DC voltage proportional to the speed setting on the throttle lever and hence represents a desired speed setting.

The signal on line 19, also a DC voltage proportional to the throttle lever setting, is input into a function generator circuit. The function generator circuit modifies the input signal to correct for the non-linear relationship between steam inlet valve travel and turbine shaft speed and is well known in the art. The function generator output signal is a desired valve position command signal proportional to the throttle lever setting and provides a first input to summing junction 20 through line 21.

The desired speed signal on line 17 is summed with an actual speed signal (input line 23) in the speed feedback circuit. The output signal from the speed feedback circuit is a speed error signal appearing on line 25 and providing a second input signal to summing junction 20. Also, input into the speed feedback circuit may be a disable signal from the interface circuit transmitted on line 27.

A third input to summing junction 20 may be a malfunction proportional control output signal on line 29. The malfunction proportional control output signal is an override signal occurring during a turbine abnormal operating condition. A second output signal from the malfunction proportional control is input into an interface circuit on line 31.

The interface circuit includes enable/disable logic and rate selection logic. The rate selection logic provides a rate selection output signal on line 33.

The output of summing junction 20 is a first input to a rate limiter on line 35. This first input to the rate limiter represents a modified valve position command signal. The output rate selection signal on line 33 is a second input signal into the rate limiter. The output signal from the rate limiter on line 37 represents the modified valve position signal input to the valve position circuit at a rate determined by the rate selection logic. The output of the rate limiter on line 37 is applied to a valve position circuit comprising a summing amplifier, a servo amplifier with feedback vis-a-vis a linear variable differential transformer (LVDT) from a hydraulic pump. The pump controls steam inlet valve position (ahead and astern) through a pair of cross-connected hydraulic rams and feedback signals to the summing amplifier are supplied on lines 39 and 41 respectively. The foregong valve position circuit and the operation thereof is more fully described in U.S. patent appliction Ser. No. 410,929, filed Oct. 10, 1973 for Taber and Cronin.

The integrated turbine control also includes an automatic rollover circuit having an actual speed input on line 43 and an enable-disable signal on line 45, the latter being supplied through the interface circuit. The output signal from the automatic rollover circuit on line 47 is a valve position command input into line 37 and activated when the throttle lever is set to zero and the turbine is at zero-speed which may range from less than one-half to two rpm's. The automatic rollover circuit and the operation thereof is more fully described in U.S. patent application Ser. No. 460,369 filed Apr. 12, 1974 for Cronin and Taber.

SPEED FEEDBACK CIRCUIT

Taking FIG. 2, the speed feedback circuit, in conjunction with FIG. 1, it will be observed that there are three input signals and one output signal. The three input signals are: the desired speed signal (line 17), the actual speed signal (line 23) and the disable signal (line 27). The output signal is a speed error signal (line 25) within the "maneuvering range" that is, for example, up to 60 percent of the rated shaft speed. Beyond 60 percent, the speed feedback circuit is disabled because speed control beyond the "maneuvering range" is no longer desirable for ship operation since it causes unnecessary valve trimming in order to null the speed error signal. Hence, beyond the maneuvering range a slight speed error is not critical and vessel operation becomes a matter of desired valve position modified by the malfunction proportional control input and rate limiter circuits.

Referring to FIG. 2, the actual speed input is obtained through redundant shaft speed pickups monitoring the high-pressure turbine and noted as HP1 and HP2 respectively. HP1 provides a first pulse train output (proportional to shaft speed) on line 51. The pulse output on line 51 becomes the input to a first "one shot" monostable multivibrator 53 on line 55. The pulse output on line 51 also is input into a first one shot retriggerable monostable multivibrator 57 on line 59. The output of multivibrator 53 is a pulse train whose frequency is proportional to shaft speed and becomes an input into NAND gate 60 through line 61. The pulse signal in line 61 is also input to direction control logic on line 63.

A second output from HP1 is input into the direction control logic on line 65 and will be either a logic low input to NAND gate 67 indicating ahead operation of the turbine or a logic high input to NAND gate 67 indicating astern operation of the turbine. The output of NAND gate 67 controls switch 69.

The output of NAND gate 60 is input into smoothing amplifier 71 on line 73 which results in a negative output DC voltage proportional to speed. If the direction control logic detects ahead operation, then the negative output signal of amplifier 71 is input into the limiter circuit. If the direction control logic detects astern operation, then the negative output signal of 71 is input into inverting amplifier 75 on line 77 because of the closure of switch 69. The gain of amplifier 75 is such that the summation of voltages at node 79 results in a positive DC voltage output proportional to shaft speed as an input into a bridge limiter circuit.

The bridge limiter circuit "clamps" the voltage level of the actual speed input on line 81 at 60 percent of rated shaft speed. Below 60 percent the voltage output of the limiter circuit is proportional to actual speed and appears on line 83.

The desired speed voltage, appropriate in magnitude and polarity, as indicated in FIG. 2, is input into the bridge limiter circuit, as shown, resulting in a desired speed output on line 85. Again, if the desired speed signal exceeds 60 percent of rated shaft speed, then the voltage input is clamped at 60 percent of rated shaft speed.

The actual speed signal (line 83) and the desired speed signal (line 85) are input into summing junction 87 and the output voltage input into inverting amplifier 89 to provide a speed error signal on line 25 assuming switch 91 to be closed. The aforedescribed bridge limiter circuit provides for "bumpless" transfer out of the speed feedback control based on the 60 percent shaft speed maneuvering range.

The speed feedback circuit can be disabled in three ways to be described. The circuit can be disabled on double failure of redundant speed pickups HP1 and HP2. The circuit can be disabled when the desired speed reference (line 17) increases above the maneuvering range limit detected through the threshold circuit. The first two disable modes are automatic. The speed feedback circuit can also be disabled through the manual disable on line 27.

Referring back to the redundant speed pickups HP1 and HP2, HP2 is connected to a second one shot monostable multivibrator 93 and a second retriggerable one shot monostable multivibrator 95. If HP1 is working properly, multivibrator 93 is "gated out" by a signal from multivibrator 57. If HP1 fails, multivibrator 57 times out and releases 93 which starts firing. The speed feedback circuit continues to function as heretofore described but uses the HP2 speed pickup as an actual speed signal. A first pickup disable signal is sent to the disable logic.

If HP2 fails a second disable logic signal is sent to the disable logic circuit which will cause at logic high output from NAND gate 97 in the disable logic causing switch 91 to open. A logic low input to NAND gate 97 from disable signal 27 will also cause switch 91 to open.

Finally, referring to the threshold circuit, a desired speed input which exceeds an adjustable threshold above 60 percent of rated shaft speed will disable the speed feedback circuit instantly without going through the limiter circuit. This occurs when the desired speed set is increased above 60 percent indicating that no speed feedback control is desired. For example, if the shaft is set at 30 percent rated speed and it is desired to increase the rate set to 70 percent rated speed, then the input change is detected in the threshold circuit and switch 91 is opened through the disable logic thereby bypassing the limiter circuit and obviating speed error signal outputs up to 60 percent in the bridge limiter circuit.

The one shot monostable multivibators may be, for example, an SN54121, available from Texas Instruments, Inc.

The retriggerable one shot monostable multivibrator may be, for example, a Fairchild 9601, available from Fairchild Camera and Instrument Company.

MALFUNCTION PROPORTIONAL CONTROL

As shown in FIG. 1, a malfunction proportional control circuit includes three circuits: a boiler control circuit, a shaft vibration circuit; and, an overspeed governing circuit. Each circuit receives its own operating condition signals from transducers which monitor the respective operating condition and each circuit except overspeed governing circuit may be individually disabled by an input operator command signal through the interface signals. The output of each circuit is gated through a select largest signal logic comprising auctioning diode circuits in combination so that the output signal of the malfunction proportional control on line 29 to summing junction 20 is a valve position command modifying signal having a magnitude proportional to the desired corrective valve action for the largest malfunction and a polarity to provide ahead or astern valve closing. Moreover, a second output from the malfunction proportional control is to the interface circuit on line 31 so that the appropriate rate of valve closing is applied through the rate selection logic.

BOILER CONTROL CIRCUIT

Figure 3:
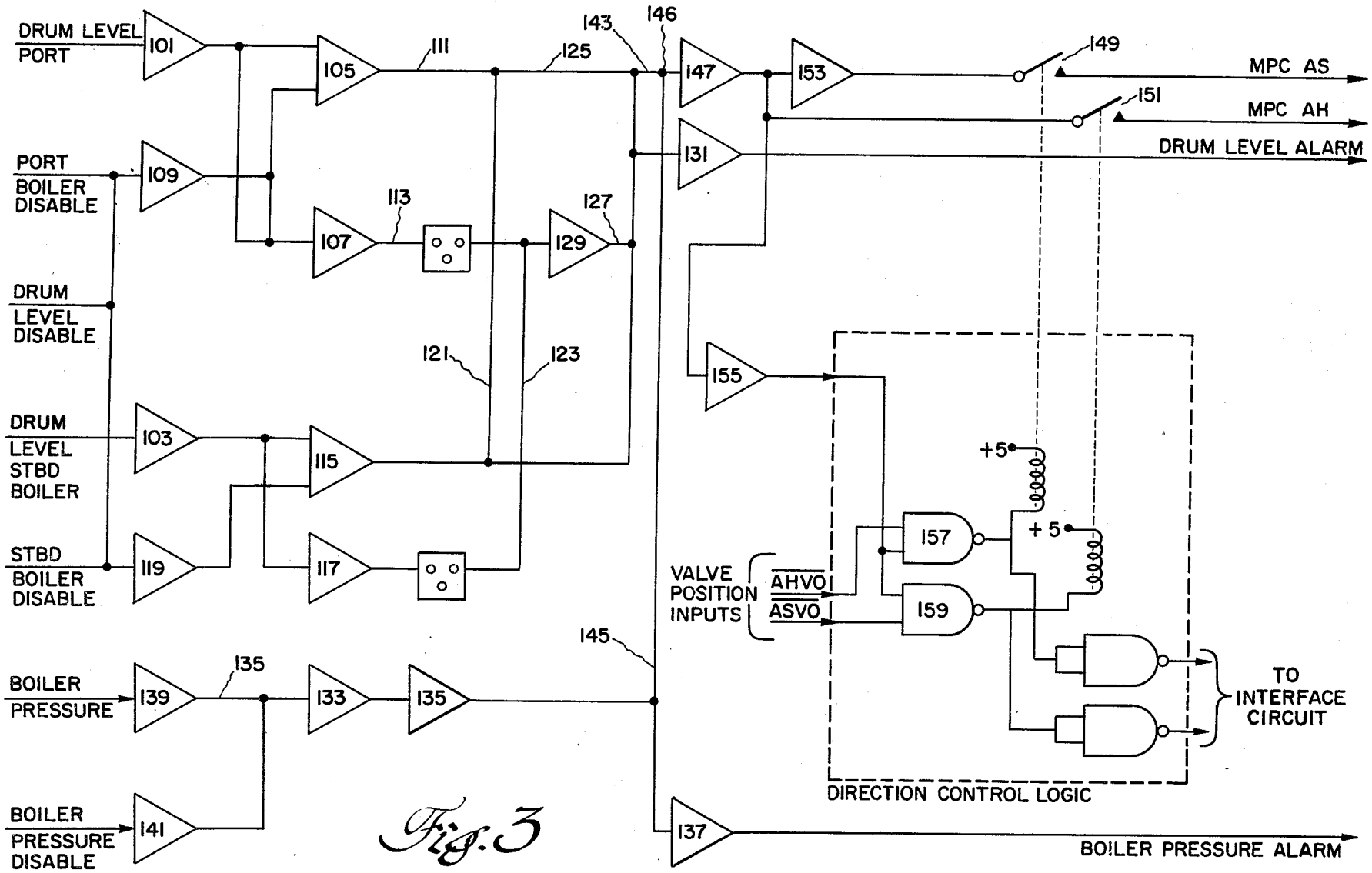
FIG. 3 is a block diagram of a boiler control board showing the directional control logic in detail.

FIG. 3 is a functional schematic diagram of the boiler control circuit comprising drum level inputs for both a port and starboard boiler and a boiler pressure input. The inputs are analog DC voltages from 1 to 5 volts proportional to the respective operating conditions.

Drum level signals are input into buffer amplifiers 101 and 103 (port and starboard respectively). The output from amplifier 101 provides a first input into threshold high circuit and amplifier 105 and also an input into threshold low amplifier 107. If the respective threshold amplifier inputs are within normal operating range (not too high or not too low as preset on the threshold circuit set by a variable resistance not shown) the amplifier outputs are zero. if a disable command is entered on the port boiler disable input through amplifier 109, the amplifier outputs from amplifiers 105 and 107 are zero. However, if the drum level signal is too high or too low corresponding to an abnormal condition, an output signal equal to the difference between the preset threshold limit and the actual drum level signal will appear on either line 111 (too high) or line 113 (too low).

Likewise, the starboard boiler is analyzed through high threshold amplifier-circuit 115 and low threshold amplifier-circuit 117 along with a starboard disable signal through amplifier 119. The high output for the starboard boiler appears on line 121 and the low output on line 123.

The higher of the two outputs on lines 111 and 121 will appear on line 125 through the use of auctioning diodes (not shown) in lines 111 and 121 respectively. The lower of the low threshold amplifier outputs will appear on line 127 after a polarity inversion by inverting amplifier 129. Any abnormal drum level condition will produce a drum level alarm through comparator 131.

Similarly, a boiler pressure threshold circuit 133 receives a boiler pressure input or disable signal on line 135. When boiler pressure is above a preset limit, the circuit output is zero volts. When the boiler pressure is below the preset limit, the threshold circuit provides an output voltage proportional to the drop in pressure from the preset limit, hence a negative voltage. The boiling threshold circuit output is input into an inverting amplifier 135 where it will trigger the boiler pressure alarm through comparator 137. Amplifier 139 is a buffer amplifier and amplifier 141 is a disable amplifier.

The signal on line 143 represents the worst (largest) of the drum level abnormal conditions whereas the boiler pressure output signal on line 145 represents a low-pressure condition (if present). The boiler pressure signal on line 145 and the drum level signal on line 143 are connected at node 146.

The output at node 146 is a positive DC voltage proportional to the largest valve close command and is input into output amplifier 147. The output from amplifier 147 will be applied to the malfunction proportional control select largest signal circuit with a polarity which is controlled by a direction control logic through switches 149 (astern) and 151 (ahead), noting the presence of inverting amplifier 153.

If there is an output from amplifier 147 through comparator 155, both NAND gates 157 and 159 will have a logic high first input. Whichever valve is open, either ahead or astern will supply a second logic high signal to its respective NAND gate causing one of the switches to close so that the appropriate malfunction proportional control signal will be supplied to the select largest signal circuit. Moreover, a logic signal is applied to the interface circuit as shown.

Provision is made in the circuit for pin selection of both high and low drum level control or high level control only following amplifiers 107 and 117 respectively.

VIBRATION CONTROL CIRCUIT

Figure 4:
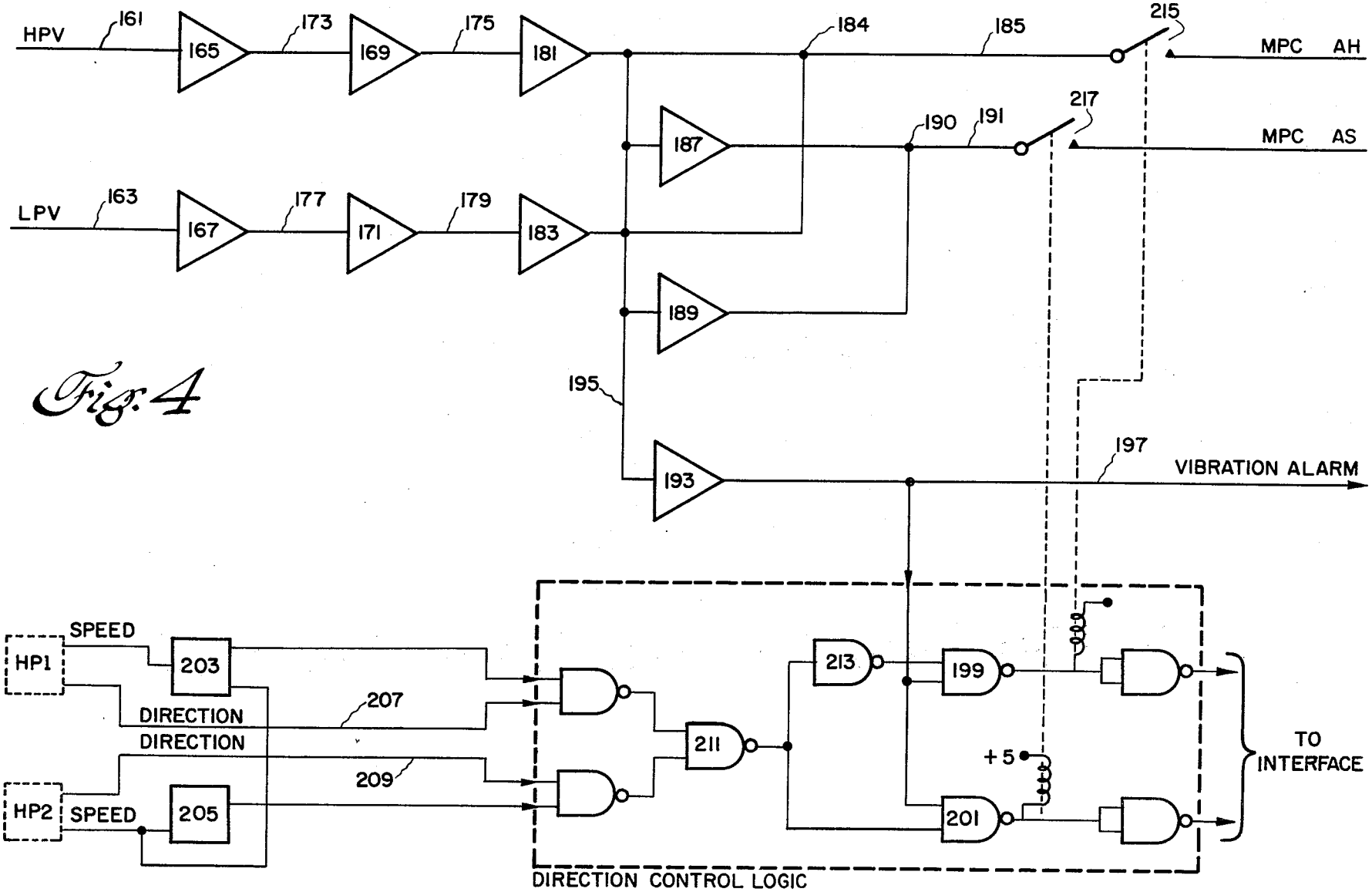
FIG. 4 is a block diagram of a shaft vibration board with the directional control logic shown in detail.

Referring to FIG. 4, there is shown a functional block diagram of a vibration control circuit. The inputs to the circuit include a vibration signal (line 161) from a vibration pickup (not shown) at a shaft bearing of the high-pressure turbine and a vibration signal (line 163) from a vibration pickup (not shown) at a shaft bearing of the low-pressure turbine.

The shaft vibration inputs are analog DC voltages in the range of 0–1 volt DC proportional to 0–1g peak vibration. The high-pressure vibration signal and the low-pressure vibration signal are input into inverting amplifier circuits 165 and 167 respectively. The high-pressure vibration signal is then applied on line 173 to a threshold amplifier and circuit 169 having a positive reference voltage applied thereto. If the negative applied voltage on line 173 is less than the reference voltage of amplifier 169, the output on line 175 is zero. If the negative applied voltage on line 173 is greater than the reference voltage of amplifier 169, then the output on line 175 will be a positive voltage proportional to the amount of excessive vibration.

Likewise, if the input voltage on line 177 to threshold amplifier circuit 171 is below a set reference voltage, the output on line 179 is zero. If the input voltage exceeds the reference voltage, then the output on line 179 is positive. Output amplifiers 181 and 183 invert the positive voltages on lines 175 and 179, respectively, to provide negative valve command signals proportional to the amount of valve closing needed to correct each vibration malfunction.

The respective outputs of amplifiers 181 and 183 are interconnected at node 184, each output having a diode prior to node 184 so that the output on line 185 is a negative valve command signal sufficient to correct the worst vibration malfunction in the ahead direction.

Likewise, the outputs of amplifiers 181 and 183 arer input through inverting amplifiers 187 and 189 to provide positive output signals. The positive output signals are connected at node 190 so that the output signal on line 191 represents a positive valve command signal sufficient to correct the worst vibration malfunction in the astern direction.

Additionally, the outputs of amplifiers 181 and 183 are input into comparator 193 on line 195. The output of comparator 193 is a logic high signal upon a negative input voltage which triggers a vibration alarm relay (line 197) and sets first inputs to a pair of NAND gates 199 and 201 in the direction control logic.

Additional inputs to the direction control logic are supplied by the redundant speed pickups HP1 and HP2 on the high-pressure turbine. HP1 provides an initial input into the direction control logic through "one shot" monostable multivibirator 203. A second output from multivibrator 203 gates out a second one shot monostable multivibrator 205. If HP1 fails, HP2 is enabled in a manner similar to that already discussed for the speed feedback circuit. HP1 or HP2 also provide direction logic signals on lines 207 and 209, respectively, depending on which pickup is operating.

A logic low input to the direction control logic indicates that the shaft is turning in the ahead direction and thus it is desired to close the ahead valve. Under this condition, the logic output of NAND gate 211 is logic low. This causes a logic high output from NAND gate 213, and a logic low output from NAND gate 199, thus causing switch 215 to close and a malfunction proportional control signal in the ahead direction to be applied to the select largest signal of the malfunction proportional control. A logic high input (astern operation) to the direction control logic provides a logic low output from NAND gate 201 causing switch 217 to close and a malfunction proportional control signal in the astern direction to be input to the select largest signal of the malfunction proportional control.

OVERSPEED GOVERNING CIRCUIT

Figure 5:
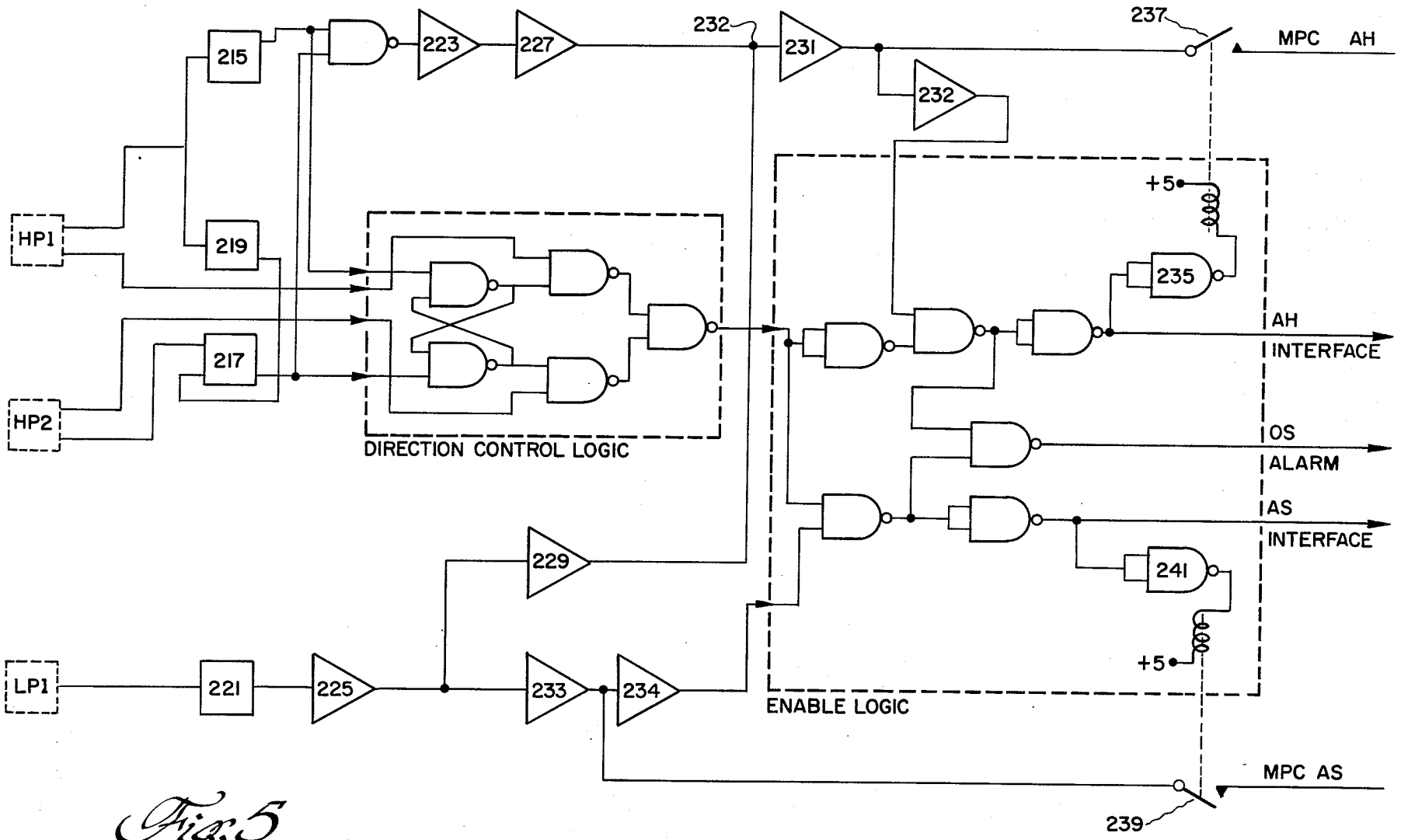
FIG. 5 is a block diagram of an overspeed board with logic details expanded.

FIG. 5, is a functional block diagram of an overspeed governing circuit with logic circuits shown for the direction control logic and the enable logic. As shown in FIG. 5, magnetic speed pickups HP1, HP2 and LP1 located on the high-pressure turbine (HP) and the low-pressure turbine (LP) produce pulse speed signals which are input to the overspeed governing circuit. If overspeed occurs in either turbine, the circuit provides an overriding signal to the summing junction 20 (FIG. 1) in order to limit the speed to slightly above maximum design rpm. As the speed is returned to normal operating limits, the steam valves return to their initial position as set by the throttle control lever.

The speed pickup pulses trigger monostable multivibrators (one shots) 215, 217 which provide output pulses whose repetition rate is proportional to shaft speed. The HP1 and HP2 one shots 215, 217 and retriggerable 219 are connected together in such a way that the output pulses from one shot 217 are inhibited by the output of retriggerable 219. If HP1 fails, retriggerable 219 will time out and release one shot 217. As earlier described for the speed feedback circuit, one shot 219 is retriggerable.

The output pulses from the HP and LP turbines (the latter through one shot multivibrator 221) are applied to smoothing amplifiers 223 and 225 to obtain linear DC analog signals proportional to the shaft speed. Both outputs of the smoothing amplifiers 223 and 225 are negative voltages proportional to shaft speed. The respective voltages proportional to the speed of the high-pressure turbine and the low-pressure turbine are applied to respective threshold amplifier circuits 227 and 229.

Each of the threshold amplifier circuits has adjustable positive voltage references typically set at a voltage proportional to 103% of rated turbine speed. If the negative input voltages do not exceed the positive preset voltage, the amplifieer outputs are zero. If one or both of the amplifier inputs exceed the threshold level as set by the positive reference, then the voltage output from either or both threshold amplifiers will be a positive voltage corresponding to the appropriate amount of valve closing. Each threshold amplifier is followed by a blocking diode so that the input to a third amplifier 231 represents the larger of the two voltages applied at node 232. The gain of amplifier 231 is typically set so that at 108% of rated speed a signal equivalent to full valve closure is achieved and is applied as an input signal to MPC ahead.

Likewise, a gain and threshold amplifier 233 receives a negative input from smoothing amplifier 225 and is typically set for initial closing at 103% and for full valve closing signal at 108% providing a valve close command to the astern valves. The MPC ahead output signal is negative whereas the MPC astern output signal is positive. The outputs of respective output amplifiers 231 and 233 are also input, respectively, into the enable logic as shown through comparators 232 and 234, respectively.

Briefly describing the direction control logic, an ahead signal from HP1 or HP2 is a logic low signal input into the direction control logic. An ahead output signal from the direction control logic will be a logic low signal. Thereafter the ahead (logic low) signal input into the enable logic will result in a logic low signal output from NAND gate 235 closing switch 237. A logic high input into the directional control logic ultimately will close switch 239 as NAND gate 241 goes low.

Ahead and astern logic outputs are also transmitted to the interface circuit as shown.

INTERFACE CIRCUIT — (ENABLE-DISABLE LOGIC)

As shown in FIG. 1, the interface circuit provides a rate selection signal to the rate limiter circuit and enable/disable signals to the malfunction proportional control, the speed feedback circuit, and the automatic rollover circuit.

Referring to FIG. 2, the speed feedback, vibration, boiler control and automatic rollover circuits are enabled or disabled by means of operator panel switches which are operator-set. When any one of the switches is in the OFF position, the interface board enable/disable logic provides a logic 1 signal to the associated circuit (logic 0 to the automatic rollover circuit) causing relays to disable the circuit. The opposite occurs when any one of the switches is in the AUTO position.

The two drum level sections (starboard and port) can also be enabled or disabled by a boiler operating switch on the engine room console, depending on which boilers are operating. The boiler control circuit also receives direction control logic from the interface logic. When the ahead or astern valves are open, the ahead or astern valve relays are energized which causes logic signals to be applied to the boiler control circuit resulting in an ahead or astern enabling signal.

The speed feedback switch and automatic rollover switch have overriding contacts (not shown) connected in series with them. The speed feedback circuit is always disabled when the throttle lever control is set to STOP or when the system is running on Handpump Mode (U.S. patent application Ser. No. 410,929, filed Oct. 29, 1973, for Taber and Cronin). The automatic rollover circuit is always disabled when the turning gear is engaged, when the throttle lever control is set to ahead or astern, or when the system is on Handpump Mode.

RATE SELECTION LOGIC (FIG. 6)

The rate selection signal (FIG. 1, line 33) to the rate limiter circuit is determined by the status of logic gates A and B. There are four possible selections as summarized in the following logic statement:

$\overline{A} \cdot \overline{B}$ = Normal Rate
$\overline{A} \cdot B$ = CB Rate
$\overline{A} \cdot B$ = MPC Ahead Rate
$A \cdot \overline{B}$ = MPC Astern Rate

NORMAL RATE

All inputs from the malfunction proportional control are logic low and the input from the crashback (CB) relay is logic high. This results in a 0,1 input to NAND gate C and 1,1 inputs to NAND gates A and B. The resultant output for selection of a normal rate selection at the rate limiter circuit is A low and B low.

CRASHBACK RATE

All inputs from the malfunction proportional control are logic low and the input from the crashback relay is logic low. This results in a 1,1 input to NAND gate C and a 0 output from gate C. The inputs to both gates A and B are both 1,0 causing gates A and B to both go logic high for crashback rate. The crashback relay is energized when the throttle lever is pulled full astern from an ahead valve open position.

MALFUNCTION PROPORTIONAL CONTROL (AHEAD-ASTERN)

If a malfunction occurs in the ahead direction, the output of the MPC ahead enable is logic low whereas the output from the MPC astern enable remains high. This results in a logic input to gate C of 0,1 and a logic high output from gate C providing first logic high inputs to gates A and B. A second input to gate B from the ahead MPC section is logic 0 so that the output from gate B is logic high or 1. A second input to gate A from the astern MPC section is logic 1 so that the output from gate A is logic low or 0. Therefore in the MPC ahead rate selection $\overline{A} \cdot B$. The reverse is true in the MPC astern so that $A \cdot \overline{B}$.

RATE LIMITER CIRCUIT

Figure 7:
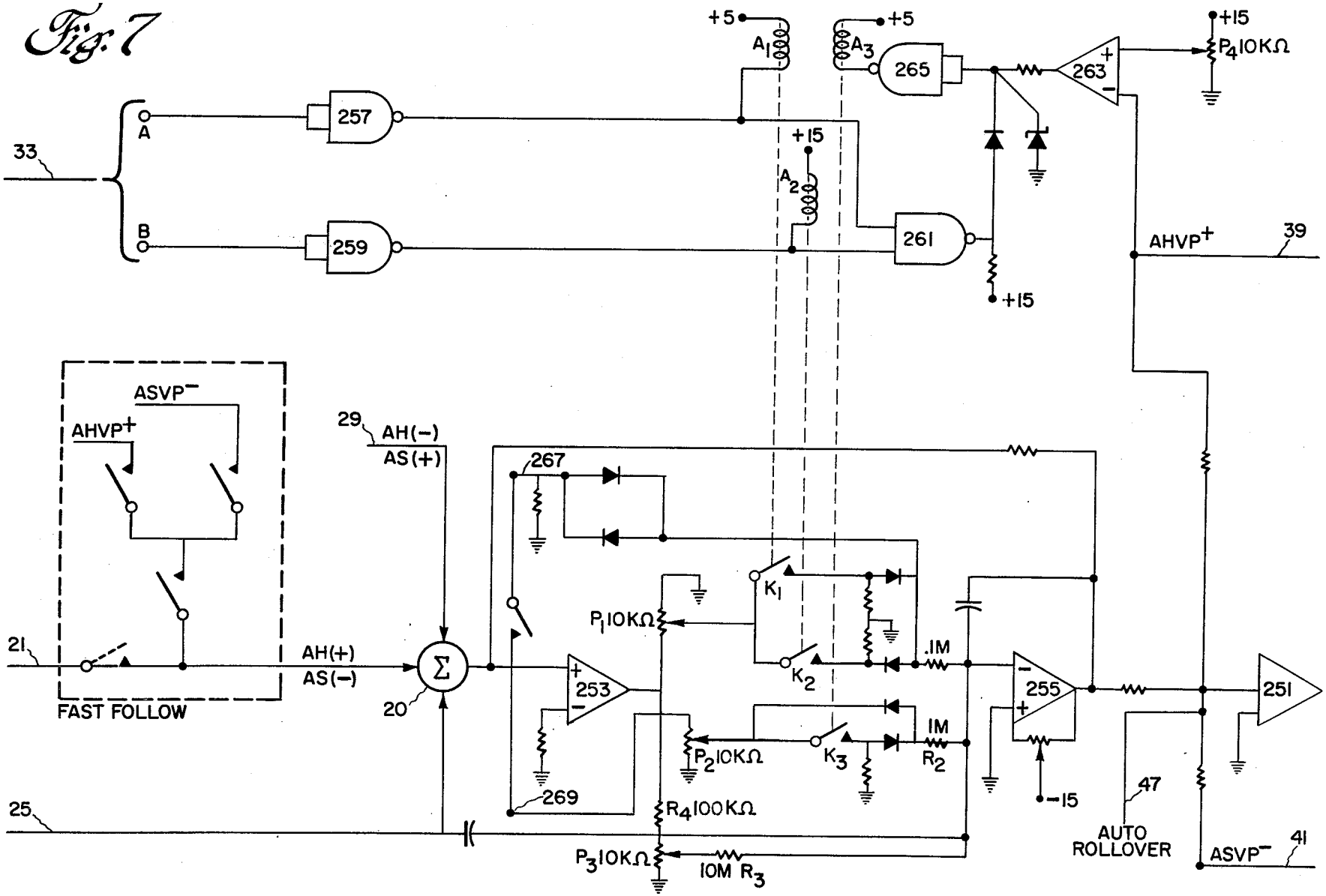
FIG. 7 is a circuit diagram of the rate limiter circuit.

Referring to FIG. 7, there is shown a circuit diagram of the rate limiter circuit having an input connected to summing junction 20 and an output connected to input amplifier 251 of the valve position circuit. Another input to the rate limiter circuit is the rate selection signal which appears on line 33.

The input to amplifier 253 is a modified valve position command, the output of amplifier 253 being input into integrator 255 which controls the valve adjustment rate depending on the selected resistance path between amplifier 253 and integrator 255. Amplifier 253 and integrator 255 are connected together to provide a rate limited proportional circuit. If the selected path is $P_1$, $R_1$, then a fast closing and fast opening rate is selected heretofore referred to as crashback. If the selected path is $P_2$, $R_2$, then normal valve opening and closing rates will apply. If the selected path is a combinantion of $P_1R_1$ and $P_2$, $R_2$, then there will be fast valve closing and normal valve opening having a designated polarity indicated by a signal to the interface circuit from the malfunction proportional control. Finally, if under normal conditions the ahead valve opening exceeds a preset limit, for example, above maneuvering range, then further valve opening will be at the slow rate.

NORMAL RATE

During the normal rate, the rate selection input is $\overline{A} \cdot \overline{B}$. This causes the outputs of both NAND gates to go high and switches $K_1$ and $K_2$ to remain open since switch actuators $A_1$ and $A_2$ do not conduct. Amplifier 263 output is high causing switch $K_3$ to close because NAND gate output 265 is low. The output of NAND gate 261 is blocked by the diode shown. The output voltage of amplifier 253 is through $P_2$, $R_2$ to integrator 255. The path through $R_4$, $P_3$ and $R_3$ is not significant when any of the switches are closed because of the high resistance valves.

CRASHBACK

During a crashback rate, i.e., the throttle control level is moved from ahead to full astern and the output rate selection signal is $A \cdot B$. This causes the outputs of both NAND gates 257 and 259 to go low thereby closing switches $K_1$ and $K_2$. The condition of switch $K_3$ is unimportant because during crashback polarity of amplifier 253 is negative. Hence the output voltage of amplifier 253 is input to integrator 255 through $K_1$, $K_2$ and $R_1$ because of the lowest resistance path through $R_1$. Corresponding valve travel is fast close ahead and fast open astern. When the crashback maneuver is complete by moving the throttle lever from full astern position, the switches $K_1$ and $K_2$ open and the normal rate is restored.

MALFUNCTION PROPORTIONAL CONTROL (AHEAD)

In the MPC (ahead) mode the rate selection signal input is $\overline{A} \cdot B$. The outputs of NAND gates 257 and 259 are logic high and logic low, respectively, so that switch $K_2$ is closed, thereby allowing the negative valve closing signal to be integrated at FAST rate so that the ahead valve will close rapidly proportional to the amount of closing set by the magnitude of the closing signal. After the malfunction has been corrected, the valve command signal will be again returned to either the normal or slow rate depending on ahead valve position.

MALFUNCTION PROPORTIONAL CONTROL (ASTERN)

In the MPC (astern) mode the rate selection signal input is $A \cdot \overline{B}$. The outputs of NAND gates 257 and 259 go low and high, respectively, causing switch $K_1$ to close. Closing switch $K_1$ causes the astern valve to close at FAST rate for a valve setting proportional to the magnitude of the positive valve close signal. Switch $K_3$ is closed and hence valve reopening is at the normal rate after the malfunction has been obviated.

SLOW RATE

The slow rate pertains to the rate of ahead valve movement at some point usually above the maneuvering range. The point at which slow rate takes effect is dependent upon the first input to amplifier 263 from potentiometer $P_4$. A second input to amplifier 263 at the inverting terminal is the ahead valve position from line 39 (ahead valve feedback signal). If the second input is lower than the first input, amplifier 263 output is a positive 12 volts or logic 1 signal to gate 265 which causes switch $K_3$ to remain closed. If the second input exceeds the first input to the amplifier, the amplifier output is a negative 12 volts or logic 0 signal to gate 265 which causes $K_3$ to open, thereby introducing the slow rate path through $P_3$ and $R_3$. The interconnection between 261 and 265 ensures that if an MPC signal is received during slow rate, valve reopening will occur at the normal rate by closing switch $K_3$ even if amplifier 263 has a logic low output.

There are two other inputs 267 and 269 which are input into the rate limiter circuit, as shown, whenever a fast follow relay, not shown, is energized. The purpose of the fast follow relay is to apply the actual valve position signal to the input of the valve position circuit so that while in the Handpump Mode or in a tripped condition, actual valve position input becomes the command signal to the position control amplifier 251 rather than the throttle control lever input. This prevents a "bump" from occurring when transferring back from handpump or a tripped condition to primary mode in the event that the throttle lever setting does not match actual valve position. The fast follow relay signal also disables the speed feedback and automatic rollover circuits in order to prevent any input signals from these circuits from affecting a smooth transfer. The fast follow relay is actuated whenever the system is not in the primary (atuomatic mode).

OPERATION

The throttle control lever is set in either the ahead or astern direction to provide an input signal to the input process circuit. The input process circuit provides two output signals. A first output signal indicating a desired speed demand is input into a speed feedback circuit. A second output signal indicating a desired valve position demand is input into a summing junction where it is added to a speed error signal (output from the speed feedback circuit) and a malfunction proportional control signal. Assuming normal operation, the malfunction proportional control signal input is zero and hence the output of the summing junction is the desired valve position demand signal modified by the speed error signal. The output signal of the summing junction is input into the rate limiter circuit which provides the appropriate normal response rate and the output signal thereof is then applied to the valve position circuit for positioning the turbine valves.

Above the maneuvering range (60 percent rated shaft speed), when the desired speed and actual speed are at 60 percent, the speed error signal is nulled and only the desired valve position command controls the positioning of the turbine valves at normal rate response. If the ahead valves are open still further, for example, to 80 percent ahead opening, then the valve command signal increases at a slow rate by the rate limiter circuit. If the throttle control lever is set above 60 percent initially, the speed feedback circuit is disabled.

If a malfunction occurs, an overriding corrective signal is input into the summing junction from the malfunction proportional control. Moreover, a signal from the malfunction proportional control is sent to the rate limiter circuit through the interface circuit to provide a corrective valve position demand signal to the valve position circuit having a magnitude proportional to the malfunction and applied at a rate suitable for the type of malfunction. If more than one malfunction occurs simultaneously, then the highest valve close signal at the fastest rate is applied to the summing junction and rate limiter, respectively.

Any automatically applied signal except overspeed may be overridden by an operator input through disable switches. The automatic rollover circuit is actuated only when the throttle lever control is at zero as described in U.S. patent application Ser. No. 460,369 to Cronin and Taber, filed Apr. 12, 1974.

While there is shown what is considered, at present, to be the preferred embodiment of the invention, it is, of course, understood that various other modifications may be made therein. It is intended to claim all such modifications as fall within the true spirit and scope of the invention.

What is claimed is:

1. A control system for at least one turbomachine wherein the output of the turbomachine is proportional to the flow of motive fluid through at least one turbomachine inlet valve, said inlet valve positioned by the control system; and, said control system comprising:

a throttle providing a first signal proportional to a desired valve position and a desired turbomachine shaft speed;

means providing a second signal proportional to actual turbomachine shaft speed;

a speed feedback circuit including a first summing junction for combining said first signal and said second signal to provide a third signal proportional to speed error;

a second summing junction for combining said first signal and said third signal to provide an inlet valve position signal;

a malfunction proportional control for providing an input signal to said second summing junction for modifying the inlet valve position signal;

rate selection logic having inputs from said throttle and said malfunction proportional control, said rate selection logic providing an output rate selection signal in accordance with said throttle and malfunction proportional control inputs; and, rate limiter means receiving said rate selection signal for applying said inlet valve position signal to said turbomachine inlet valve at a rate set by said rate selection logic.

2. A control system for a marine turbine power plant, said power plant having at least one ahead turbine and at least one astern turbine; each turbine having an output proportional to the flow of motive fluid through respective ahead and astern turbine inlet valves; said ahead and astern inlet valves selectively positioned by a valve position circuit according to a signal from said control system; said control system comprising:

a throttle providing a first signal proportional to a desired valve position and a desired turbomachine shaft speed;

means providing a second signal proportional to the actual turbomachine shaft speed;

a speed feedback circuit including a first summing junction for combining said first and second signals to provide a third signal proportional to speed error;

a second summing junction for combining said first and third signals to provide an inlet valve position signal;

a malfunction proportional control providing an input signal to said second summing junction for modifying the inlet valve position signal;

rate selection logic having inputs from said throttle and said malfunction proportional control, said rate selection logic providing an output rate selection signal in accordance with said throttle and malfunction proportional control inputs; and rate limiter means receiving said rate selection signal for applying said inlet valve position signal to said turbomachine inlet valve at a rate set by said rate selection logic.

3. The control system recited in claim 2 wherein said first signal is input into said speed feedback circuit and also into said second summing junction, and said second signal is input into said speed feedback circuit; and, wherein said speed feedback circuit further comprises:

a first preset signal limiter between said first signal input and said first summing junction;

a second preset signal limiter between said second signal input and said first summing junction; the preset values of said first and second limiters being equal; and, said third signal proportional to speed error is equal to the difference between said first and second signals when at least one signal is below the preset value; and, the third signal is zero when said first and second signals are at and above the preset value.

4. The control system recited in claim 6 wherein the speed feedback circuit further comprises:

first and second redundant speed pickups for providing said second signal actual speed input;

digital means interconnecting said first and second speed pickups whereby the second speed pickup is enabled upon failure of the first speed pickup;

logic means for disabling the speed feedback circuit upon failure of both speed pickups;

direction control logic for controlling the polarity of the second signal actual speed input for ahead and astern operation; and, a threshold circuit through said logic means for disabling the speed feedback circuit when said first signal input exceeds an adjustable threshold value above the preset value of the signal limiter.

5. The control system recited in claim 15 wherein said rate limiter means comprises:

an input amplifier for receiving the inlet valve position signal from said second summing junction;

first, second, and third parallel rate selection channels corresponding to fast, normal and slow rates of valve operation, respectively; said rate selection determined by selective closure of switches according to the rate selection signal from said rate selection logic;

an integrating amplifier receiving the output from at least one of said rate selection channels according to the rate selection signal the integrating amplifier output being input into said valve position circuit.

6. The control system recited in claim 2 wherein said rate selection logic includes:

first and second output NAND gates for providing a rate selection signal to said rate limiter means:

a first input to said first NAND gate for indicating the occurrence of an astern malfunction signal;

a first input to said second NAND gate for indicating the occurrence of an ahead malfunction signal;

a third NAND gate having a first logic input for indicating the occurrence of a crashback relay signal, and a second logic input indicating the occurrence of a malfunction signal; said third NAND gate output becoming second inputs to said first and second output NAND gates.

7. A control system for a marine turbine power plant, said power plant having at least one ahead turbine and at least one astern turbine; each turbine having an output proportional to the flow of motive fluid through respective ahead and astern turbine valves; said inlet valves selectively positioned by a valve positioning circuit according to an inlet valve control signal from said control system; and, said control system comprising:

means for providing a first signal proportional to a throttle setting;

means providing a second signal proportional to actual shaft speed;

a speed feedback circuit including a first summing junction for comparing said first and second signals to provide a third signal proportional to speed error;

a second summing junction for combining said first and third signals to provide an inlet valve control signal;

rate limiter means having at least two selectable rates for applying said inlet valve control signal to said turbine valve positioning circuit;

logic means for selecting at least one of said two rates depending upon said throttle setting and providing a rate selection signal to said rate limiter means.

8. The control system recited in claim 7 further comprising:

means for detecting the occurrence of at least one power plant operating malfunction and providing a first output proportional malfunction signal for overriding said inlet valve control signal prior to said rate limiter means;

a second output logic signal from said malfunction detection means to said logic means; and, said logic means providing a rate selection signal to said rate limiter means comprising a combination of said first and second rates.

9. The control system recited in claim 2 wherein said malfunction proportional control comprises:

a boiler control circuit having drum level and pressure inputs, and an output signal proportional to the largest of any boiler malfunction;

a vibration control circuit having ahead and astern turbine shaft vibration inputs, and an output proportional to the largest of any shaft vibration malfunctions;

an overspeed control circuit having actual speed inputs from said ahead and astern turbines and an output proportional to the largest of any overspeed malfunctions; and, select largest signal logic having inputs from said boiler control, vibration control and overspeed control circuits to provide a signal output proportional to the largest malfunction, said select largest logic output signal being input into said second summing junction for modifying inlet valve position signal.

* * * * *